US006142733A

United States Patent [19]

Alizadeh et al.

[11] Patent Number: 6,142,733

[45] **Date of Patent: *Nov. 7, 2000**

[54] STATOR FOR FAN

[75] Inventors: Ahmad Alizadeh, Indianapolis, Ind.; Antony Szczodrowski, Maurepas, France

[73] Assignee: Valeo Thermique Moteur, La Verriere, France

[ * ] Notice: This patent issued on a continued prosecution application filed under 37 CFR 1.53(d), and is subject to the twenty year patent term provisions of 35 U.S.C. 154(a)(2).

[21] Appl. No.: 09/223,262

[22] Filed: Dec. 30, 1998

[51] Int. Cl.[7] ..... F01D 1/02

[52] U.S. Cl. ..... 415/208.2; 415/211.2; 415/228; 416/169 A; 416/189

[58] Field of Search ..... 415/208.2, 208.5, 415/228, 211.2; 416/169 A, 189, 237

[56] References Cited

U.S. PATENT DOCUMENTS

| | | | |
|---|---|---|---|
| 2,154,313 | 4/1939 | McMahan | 415/210.1 |
| 2,224,519 | 12/1940 | McIntyre | 415/192 |
| 2,524,869 | 11/1950 | Adamtchik | 415/210.1 |
| 4,208,167 | 6/1980 | Yasugahira et al. | 415/210.1 |
| 4,548,548 | 10/1985 | Gray, III | 416/189 |
| 4,563,622 | 1/1986 | Deavers et al. | 318/254 |
| 4,636,669 | 1/1987 | Plunkett et al. | 310/51 |
| 5,066,194 | 11/1991 | Amr et al. | 415/223 |
| 5,342,167 | 8/1994 | Rosseau | 415/119 |
| 5,460,485 | 10/1995 | Sugiyama et al. | 415/208.2 |
| 5,466,120 | 11/1995 | Takeuchi et al. | 415/119 |
| 5,577,888 | 11/1996 | Capdevila et al. | 415/210.1 |

*Primary Examiner*—Edward K. Look
*Assistant Examiner*—Rhonda Barton
*Attorney, Agent, or Firm*—Morgan & Finnegan, LLP

[57] ABSTRACT

A fan assembly comprising a fan, a stationary airflow directing device and a support inner ring. The fan has a hub portion and a plurality of fan blades. Each of the fan blades has a root region and a tip region. The root regions of each fan blade are secured to the hub portion wherein the fan blades extend substantially radially of a fan rotational axis. The airflow directing device has a plurality of stator blades extending radially about the support inner ring. The stator blades receive air flow from the fan and divert the airflow. The surface area of the stator blades is substantially less than the surface area of the fan blades. Each stator blade has a planar surface and a curved surface opposing the planar surface. The planar surface is disposed such that rotational components of air flow from the fan are incident on the planar surface.

42 Claims, 11 Drawing Sheets

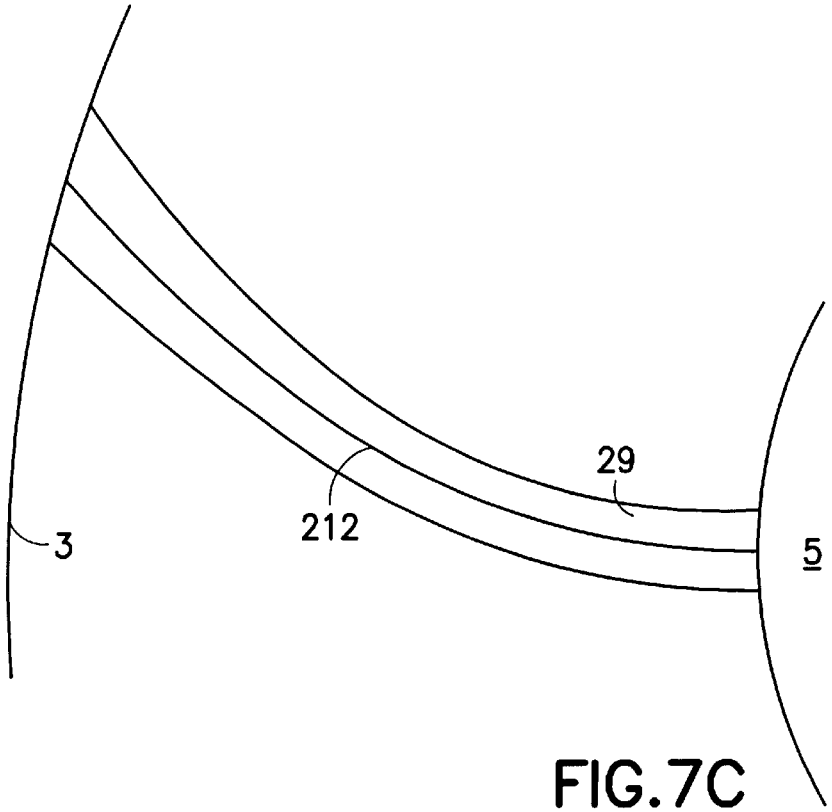
FIG.7C
FIG.7D
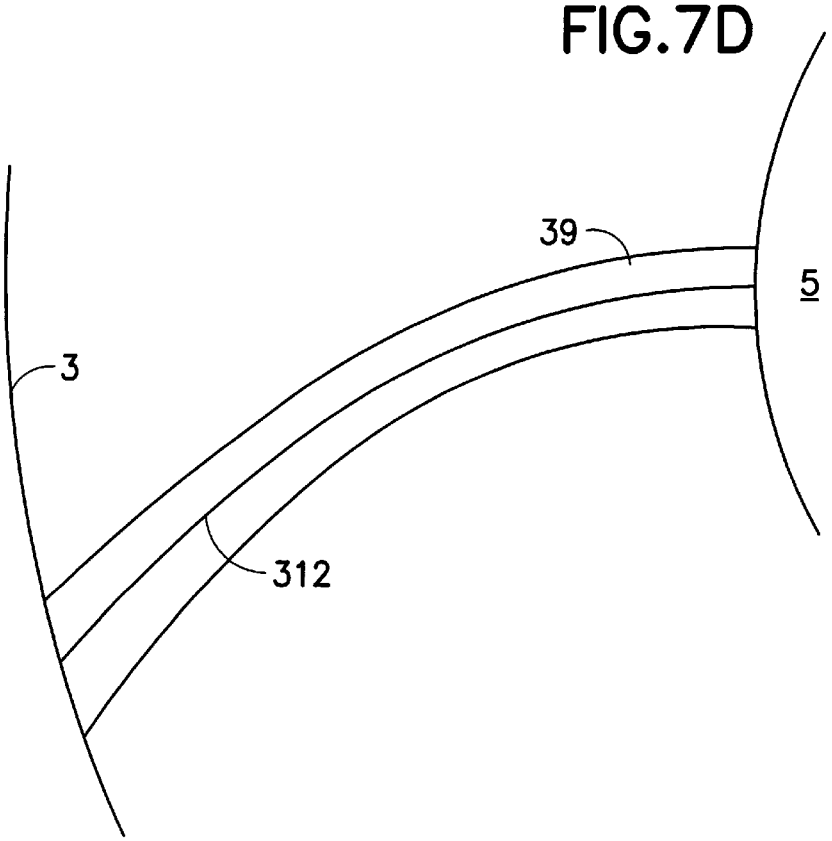

STATOR FOR FAN

FIELD OF THE INVENTION

The present invention relates to the field of stators for fans, and more specifically but not exclusively to a fan device comprising a fan and a stator device, and to a fan assembly for moving air through a heat exchanger.

BACKGROUND TO THE INVENTION

The use of fans to move air through heat exchangers is well known, for example in the field of air conditioning and the field of motor vehicle cooling. A fan for such an application may consist of a hub member and a plurality of blade members, each blade member having a root portion and a tip portion, the root portions of each blade being secured to the hub portion such that the blades extend substantially radially of the hub portion. A blade tip support ring may link the blades near to, or more usually at, their tip portions.

Such a fan, which is often driven by an electric motor, or via a transmission from an associated engine, is usually disposed so that the fan radial plane extends parallel to a face portion of the associated heat exchanger.

Fans of this type are commonly referred to as "axial flow fans". However, although the blades are pitched so as to move air in an axial direction, nevertheless the action of the fan causes a relatively complicated air flow. It will, for example, be apparent that rotation of the fan causes air which has passed through the fan to have a rotational component of motion, due to the movement of the blades, as well as a linear component induced by the pitch of the blades. Leakage of air around the fan blade tips (so-called tip vortices) between the high and low pressure sides of the fan may also occur.

Furthermore, the particular blade form and the particular blade disposition selected for a fan, for example the dihedral angle of the blade, the variation in pitch along the blade span or the chord length of the blade (taken along a radial cross section) will affect the pressure distribution provided immediately adjacent the fan, and hence will affect the flow of air which has passed through the fan.

A fan of the type used to move air through a heat exchanger is intended to provide air flow in an axial direction; components in other directions are wasteful of energy. Such wasteful components of air flow impinge upon the various mechanical structures around the heat exchanger and upon the heat exchanger itself to increase the overall noise produced by the system.

The applicant has previously researched and applied for patents in the field of so-called stators, which act on airflow from a fan to at least partly straighten the flow and thus to at least partially mitigate the above mentioned difficulties. Prior stators have been effective, but the applicant has found that certain geometries and configurations yield especially advantageous results.

It is therefore an object of the present invention to provide devices which enable improved performance.

SUMMARY OF THE INVENTION

According to one aspect of the present invention there is provided a fan assembly comprising a fan, a stationary airflow directing device and a support ring for supporting the fan, said fan having a hub portion and a plurality of fan blades, each fan blade having a root region and a tip region, the root regions of each fan blade being secured to the hub portion whereby the fan blades extend substantially radially of a fan rotational axis, the airflow directing device having a plurality of stator blades extending radially from said fan support ring, said stator blades, in use, receiving air flow from said fan and diverting said airflow, wherein the surface area of the stator blades is less than 30% of the surface area of the fan blades.

Preferably the airflow directing device further comprises a stator support outer ring, said stator support outer ring defining an air passage, said fan being disposed within said air passage to move air therethrough, and said stator blades are secured to said stator support outer ring at their tips.

Preferably, a chord length of each stator blade varies along the length thereof.

Conveniently a clearance between the stator support outer ring and the fan is greater than 0.5% and less than 2% of the fan diameter.

Advantageously, each stator blade has a substantially constant chord length over about the first 50% of the distance between the fan support collar and the stator support outer ring, and thereafter the chord length increases.

Preferably the minimum distance between the stator and the blade trailing edge is equal to or greater than 30% of the minimum chord of the stator.

Conveniently, each fan blade has a fan blade medial line which, in the tip region, is circumferentially offset from the fan blade medial line in the root region, whereby the fan blades are skewed, and each stator blade has a stator blade medial line which, at the tip region thereof is circumferentially offset from the stator blade medial line in the region underlying the fan hub portion whereby the stator blades are skewed, wherein the direction of the skew of the fan blades is opposite to the direction of the skew of the stator blades.

Preferably each stator blade has a first and a second surface, said second surface opposing said first surface, and at least said second surface is curved, whereby the maximum deviation of a line equidistant the first and second surfaces from the stator blade chord is at most 6% of the chord length of the stator blade.

Advantageously said first surface is planar and is disposed such that, in use, rotational components of air flow from said fan are incident on said first surface.

Preferably, the number of stator blades does not correspond with the number of fan blades.

Advantageously, an odd number of stator blades is provided.

Conveniently said odd number is a prime number,

Advantageously, said fan is adapted to rotate in a predetermined sense whereby said fan blades have a leading and a trailing edge, and the projection of said first edge onto a plane perpendicular to the axis of rotation of the fan corresponds to the projection onto said plane of the trailing edge of each fan blade.

Preferably the angle of incidence of air flow on the stator blades is less than the angle between the exit angle of air flow from the fan blades, said exit angle being defined as the angle between the air flow from the fan blades and the axial direction of the fan.

Advantageously the air incidence angle on the active surface of the stator blade in the region of maximum air speed is less than the exit angle of air from said stator blade.

Conveniently the camber of the stator blade is selected as a function of both the camber of the fan blades and the configuration of the fan blades.

Conveniently the profile of the stator blade is selected as a function of both the profile of the fan blades and the configuration of the fan blades.

According to a second aspect of the present invention there is provided fan assembly comprising a fan, a stationary airflow directing device and a support inner ring, said fan having a hub portion and a plurality of fan blades, each fan blade having a root region and a tip region, the root regions of each fan blade being secured to the hub portion whereby the fan blades extend substantially radially of a fan rotational axis, the airflow directing device having a plurality of stator blades extending radially about said support inner ring, said stator blades, in use, receiving air flow from said fan and diverting said airflow, wherein the surface area of the stator blades is less than 30% of the surface area of the fan blades, wherein each stator blade has a first and a second surface, said second surface opposing said first surface, said first surface is planar and said second surface is curved wherein said first surface is disposed such that, in use, rotational components of air flow from said fan are incident on said first surface.

According to a further aspect of the invention there is provided an air flow directing device for use with an axial flow fan, the device comprising a support inner ring for supporting the fan and the plurality of stator blades extending radially about said support inner ring, said stator blades, in use, receiving air flow from said fan and directing said air flow, wherein each stator blade has a first and a second surface, said second surface opposing said first surface, said first surface being substantially planar and disposed such that, in use, rotational components of air flow from said fan are incident on said first surface, and said second surface being curved.

Preferably the maximum deviation of a line equidistant the first and second surfaces from the stator blade chord is at most 6% of the chord length.

Conveniently, there are provided three support arms.

Alternative, there is provided a single support arm.

Advantageously, at least one arm is of U-shaped cross-section, whereby wiring for said motor is carried within the U-shaped cross-section.

Advantageously the air flow directing device further comprises a stator blade support outer ring connecting together the plurality of air flow directing members and disposed between the outer ring and the inner ring.

BRIEF DESCRIPTION OF THE DRAWINGS

Embodiments of the invention will now be described with respect to the accompanying drawings, in which:

FIGS. 7A–7D shows projections of different stator blades onto a plane orthogonal to the axis of the stator of FIG. 1;

In the figures like reference numerals refer to like parts.

DESCRIPTION OF THE PREFERRED EMBODIMENTS

Figure 1:
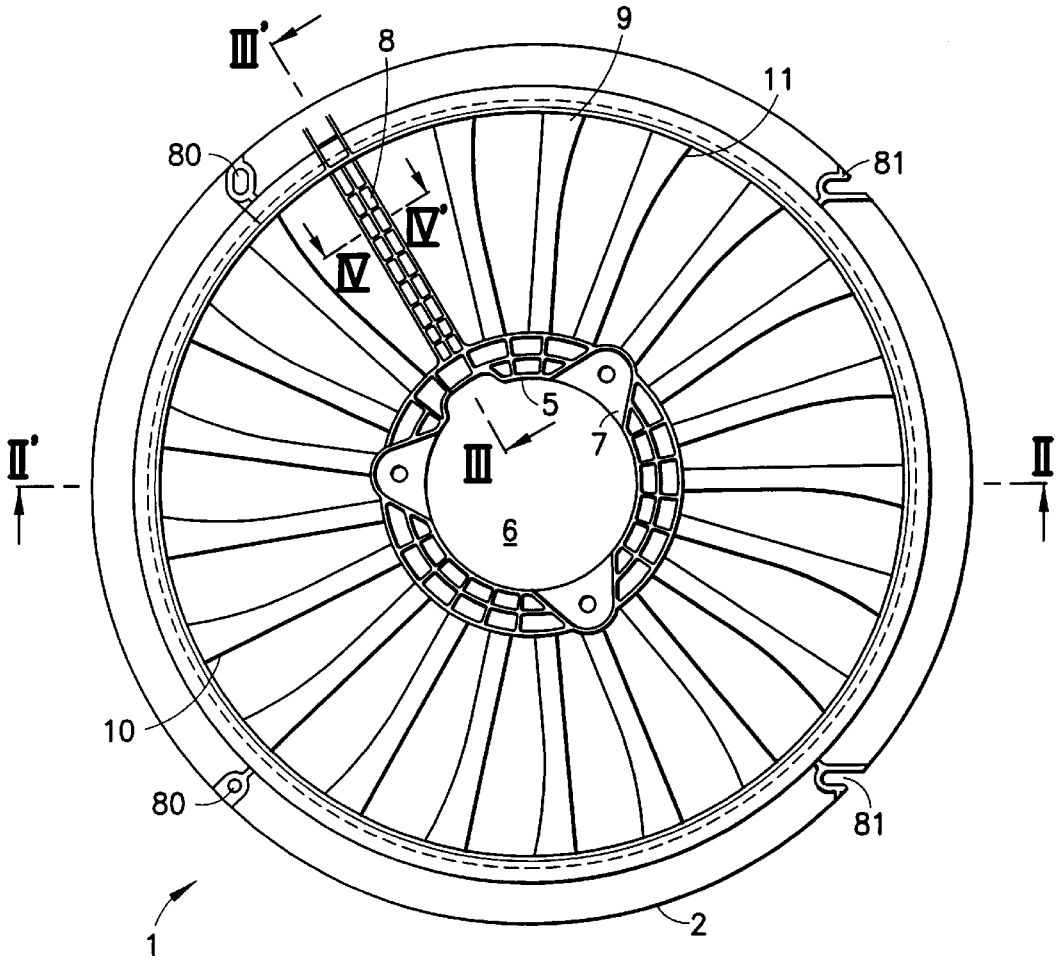
FIG. 1 shows a front elevation of a first embodiment of a stator assembly in accordance with the invention.
Figure 2:
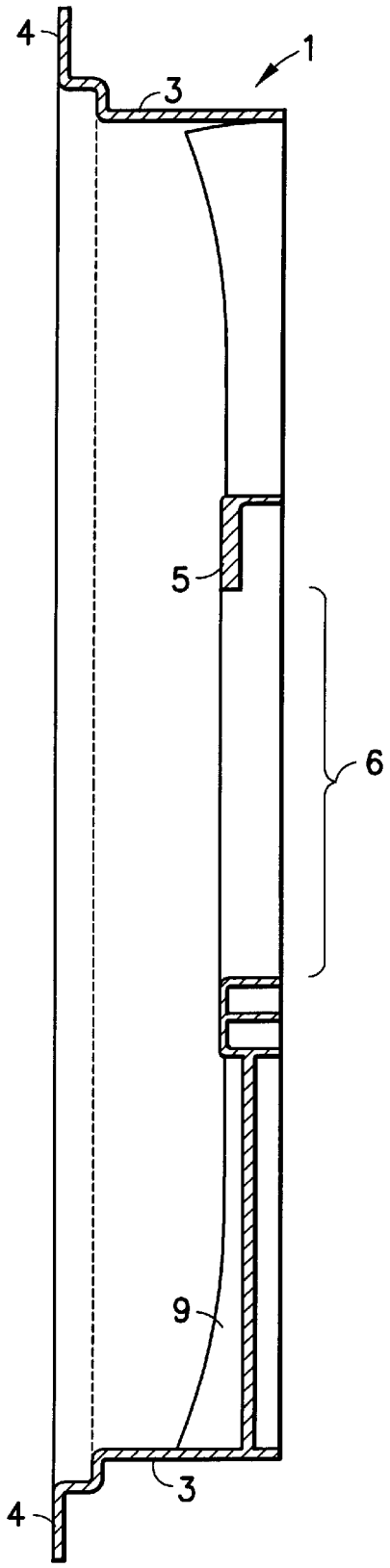
FIG. 2 shows an axial cross section through the stator assembly of FIG. 1, taken along the line II–II'.

Referring now to FIG. 1, a stator assembly 1 for a fan consists of a stator support outer ring 2, forming a fan shroud, the stator support outer ring being referred to hereinafter as an outer ring, a stator support inner ring 5, referred to hereinafter as an inner ring, a support arm 8 and twenty stator blades 9. The outer ring is annular and, as can be seen in FIG. 2, has a generally cylindrical portion 3 and an outwardly-extending flange portion 4. The outer ring 2 accordingly defines a circular passage for the flow of air, which passage is concentric with the inner ring 5. The outer ring is provided with appropriate mounting points, here two holes 80 for screws or bolts and two slots 81 for a bayonet fastening. Alternatively clips or other fastenings could be substituted.

The inner ring 5 as shown in FIG. 1, defines a generally circular aperture 6 within which is secured a fan motor. The inner ring 5 has three outwardly-extending flange portions 7, each with a respective securing hole, for the motor. The inner ring 5 is maintained concentric with the air flow passage primarily by the support arm 8 which extends substantially radially of the passage. The support arm 8 has a generally U-shaped cross section (see FIG. 4) and is substantially rigid. The stator blades 9, serve to direct the flow of air and extend between the inner ring 5 and the outer ring 3. Each stator blade 9 is substantially radial to the passage in the embodiment shown in FIGS. 1 and 2, but other forms and orientations are possible as will be described later herein.

It is possible to have no support arms, this support function being assumed by the stator blades. In an alternative embodiment three support arms are provided.

The stator blades straighten the air flow resulting from the movement of the fan. By so straightening the air flow, the speed of the flow is reduced, which reduces the acoustic losses. One effect of the stator blades is to reduce turbulence, and to maximise the total air flow which is distributed across the air flow passage. However, the stator blades may also support the inner ring 5.

Figure 5:
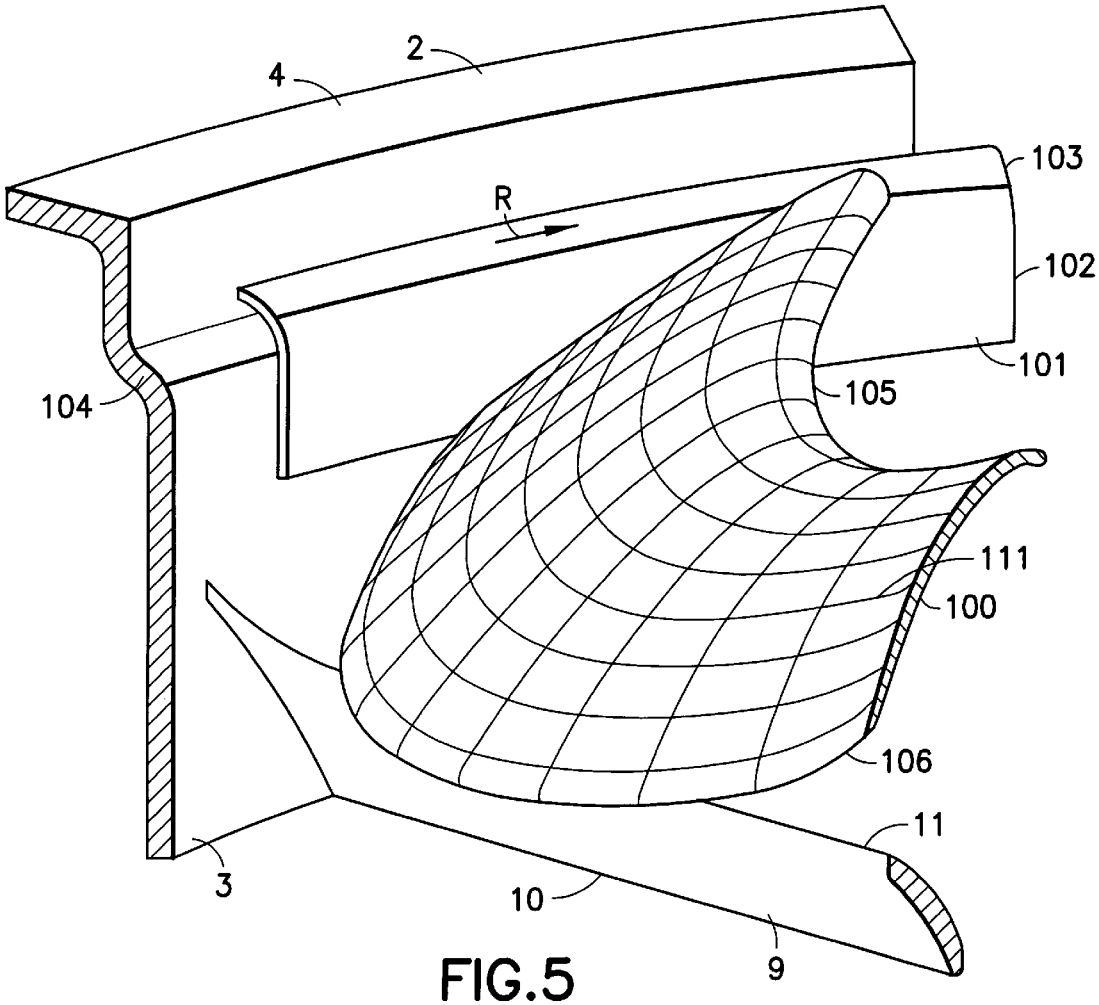
FIG. 5 shows an isometric view of a portion of a fan assembly comprising a stator assembly in accordance with the invention.

As shown in FIGS. 1, 5, 6 and 7 the stator blades of this embodiment each have a trailing edge 10—the edge remote from the fan—which is substantially straight. The leading edge 11—the edge nearest to the fan, as best seen in FIGS. 2, 5 and 7 is curved, as will be described later herein.

Figure 6:
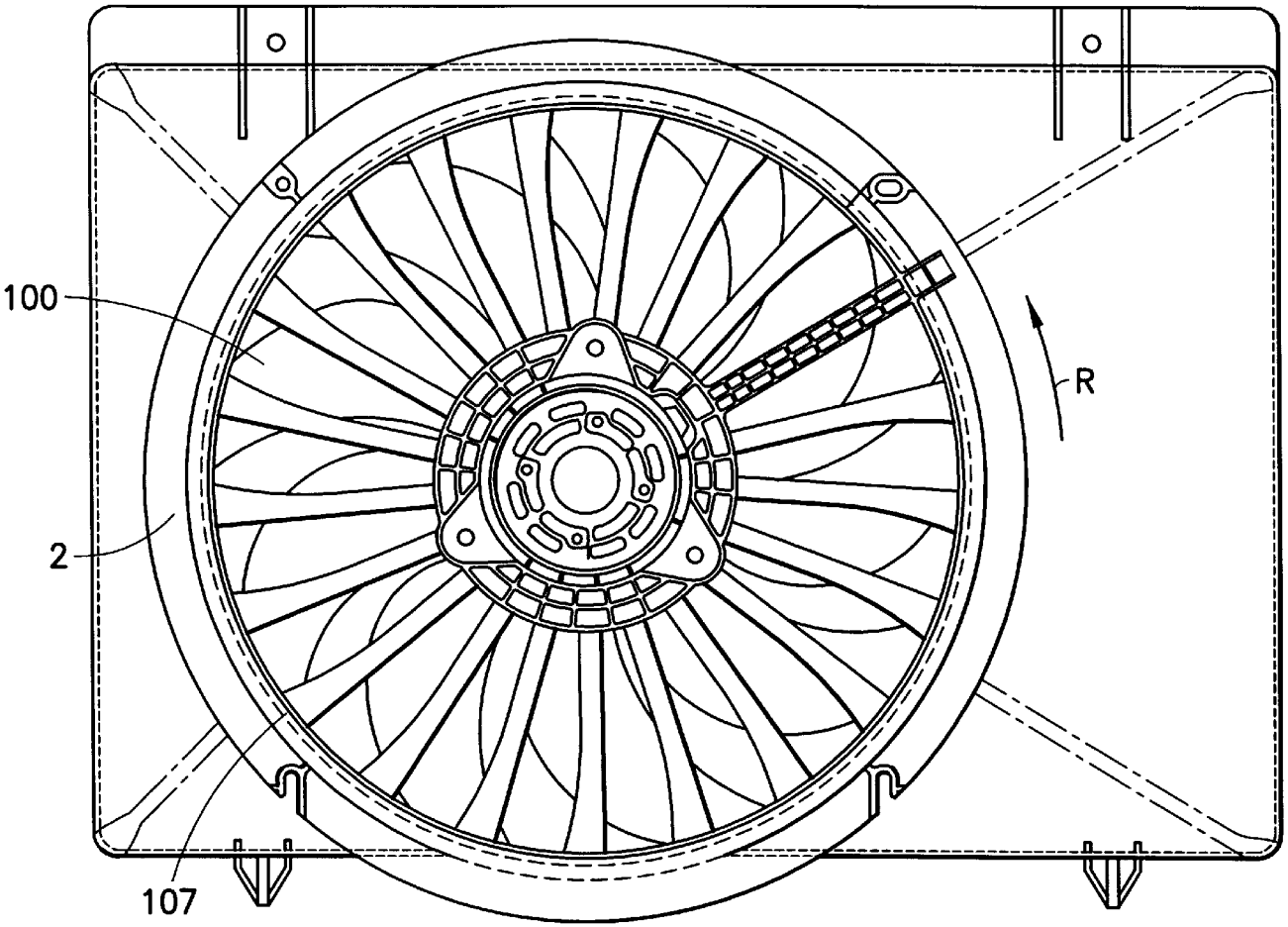
FIG. 6 shows an elevation of the fan assembly of FIG. 5.
Figure 7A:
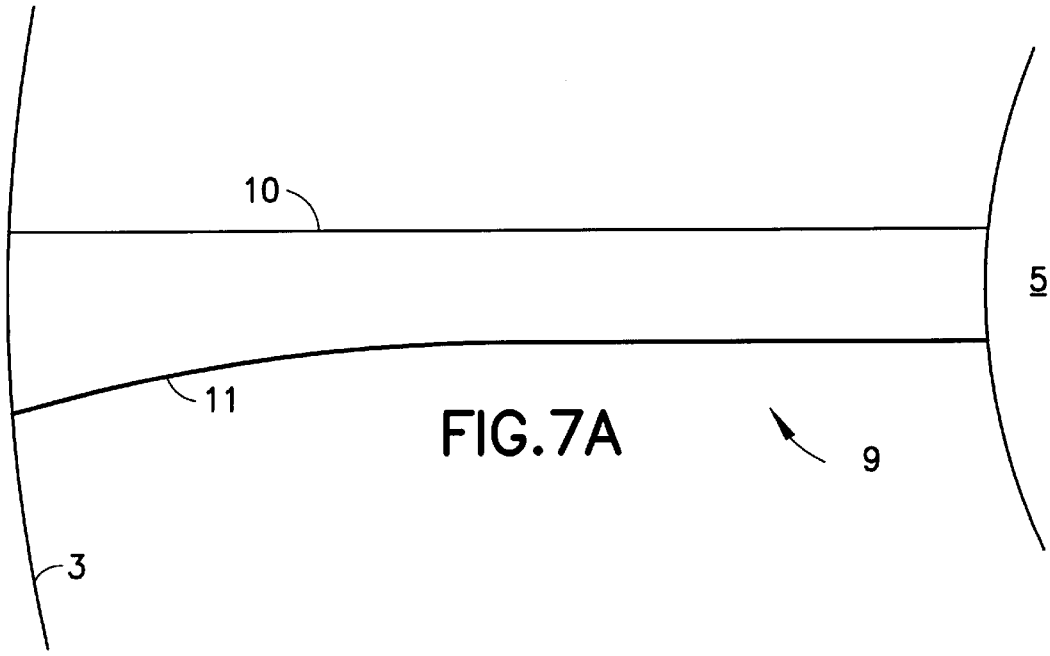

Referring to FIGS. 5 and 6, a fan has a plurality of blades 100 secured at a root region thereof to a hub portion 105 of the fan so that the blades extend substantially radially of the rotational axis of the fan. The fan also has a blade tip support member 101 referred to hereinafter as a blade ring which extends about the tip regions of each blade. The blade ring, as seen in FIG. 5, has a generally cylindrical portion 102 and an outwardly-belled flange portion 103 as known in the art. The blade ring rotates with the blades, and serves a number of functions, for example adding to the stiffness of the fan structure and, due to interaction with the outer ring 2, reducing the reflux of air around the blade tips, the so-called "tip vortices". As can clearly be seen in FIG. 5, the outer ring 2 of the stator has an outwardly-curved portion 104 which generally conforms to the outward bell curve of flange portion 103 of the blade ring so that the clearance between the blade ring and the outer ring 2 is kept as small as possible. Desirably the clearance lies between 0.5% and 2% of the fan diameter.

The fan rotates in the direction "R", and is electrically driven. There may be a separate electric motor having a shaft for driving the fan, or the hub portion of the fan may be the rotor of the motor, or integrally attached to the rotor. A conventional commutator, or electronic commutation may be used in the event of DC operation.

As shown clearly in FIG. 5, the fan blade 100 is pitched, ie a leading edge 105 of the fan blade 100 does not lie in the same plane as the trailing edge 106 of the fan blade, Specifically, at the blade ring 101, the leading edge 105 is substantially coincident with the upper (as shown in FIG. 5) extremity of the blade ring while the trailing edge 106 is substantially coincident with the lower extremity of the blade ring 101. Moreover, the medial line 111 of each fan blade curves forwardly with respect to the direction of rotation R from the root region of the fan blade to the tip region. This form of fan blade is said to be forwardly-skewed. The pitch of fan blade 100, defined by the acute angle between the blade chord and the diametric plane, varies along the radial extent of the fan blade. In one advantageous fan, the pitch remains approximately constant for the inner first half of the fan blade extent and then rises. Furthermore, the fan blade shown in FIG. 5 has a dihedral angle, namely the angle between the tangent plane to the fan blade at a point on the fan blade surface and a plane transverse to the axis of the fan, which varies along the extent of the fan blade. The particular form of the fan blade shown in FIG. 5 is illustrative.

In one embodiment, the leading edge 11 of each stator blade 9 defines a contour which corresponds to the contour produced by rotation of the trailing edge 106 of the fan blades, Thus, as the blade 100 of the fan rotates with respect to the stator blade 9, respective points on the trailing edge 106 of the fan blade and the closest edge 11 of the stator blade which are in rotational coincidence are axially spaced by a substantially constant amount. In this embodiment, the trailing edge 10 of the stator blade is generally straight. Moreover the support arm 8 is also generally straight.

Figure 3:
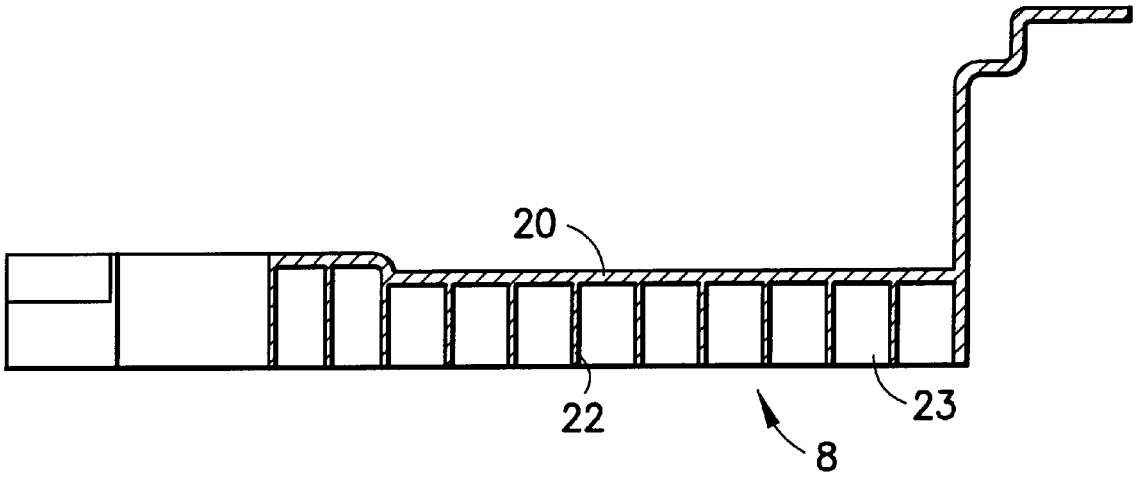
FIG. 3 shows a longitudinal cross section along line III–III' in the stator assembly of FIG. 1.
Figure 4:
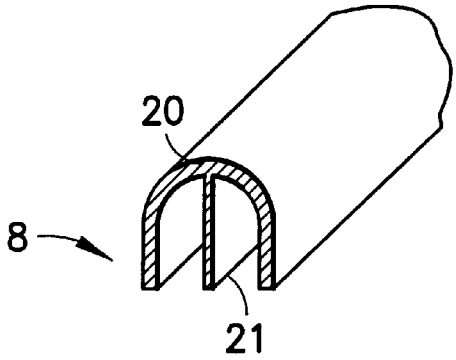
FIG. 4 shows a transverse cross section and partial perspective view of the support arm of FIG. 3 taken along line IV–IV' in FIG. 1.

Referring to FIGS. 3 and 4, the support arm 8 has a portion of an inverted U-shaped cross section to define a convex outer surface 20. Depending from the centre of the U-shaped portion is a generally straight portion 21. As seen in FIG. 3, the support arm 8 has a plurality of transverse partitions 22 spaced apart along the axis of the arm 8 and extending across the U-shaped portion 20, to define a plurality of downwardly-open boxes 23 for strength. The convex outer surface 20 allows smooth air flow thereover.

In use, the downwardly-depending portion 21 supports electrical wires which extend from the outer ring 2 to an associated fan motor.

A number of different stator configurations are possible and these are exemplified in FIGS. 7A–D, The first form, 9 of stator blade extends radially between the inner 5 and the outer ring 3. The trailing edge 10 is substantially straight and the leading edge, as previously described is curved.

Figure 7B:
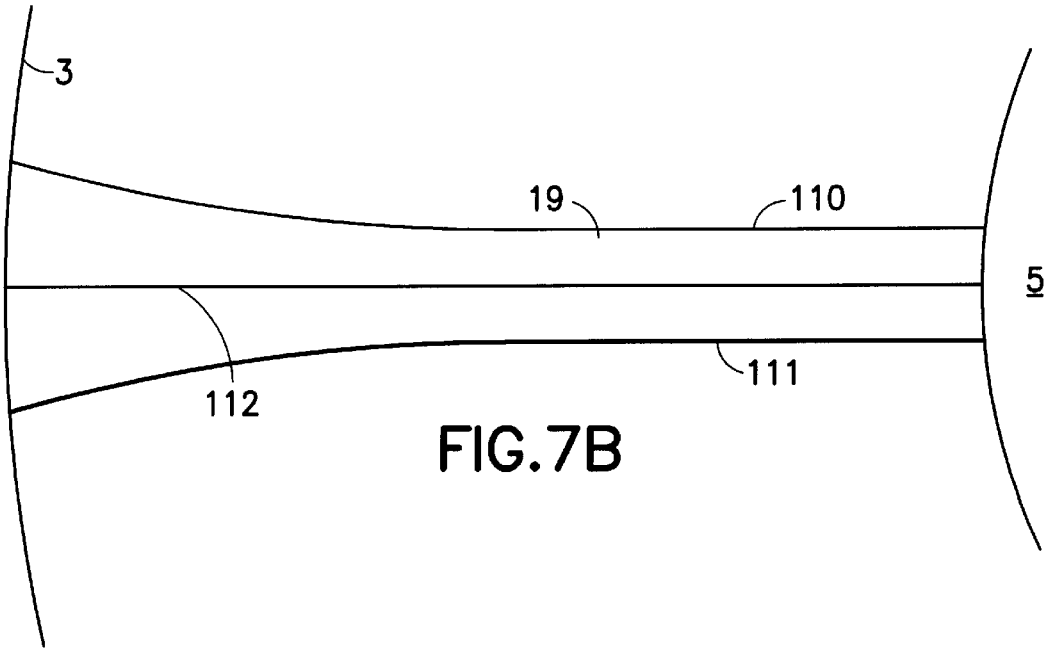

Referring now to FIG. 7B, a second form 19 of stator blade will now be described. The stator blade 19, similar to stator blade 9, extends generally radially between the inner ring 5 and the outer ring 3. The edges 110,111 of the stator blade 19 are substantially parallel to one another for approximately the first 50% of the radial extent of the stator blade 19 from the inner ring 5 to the outer ring 3. Thereafter, the edges diverge substantially symmetrically from a radial medial line 112. Thus, at the outer ring 3, the circumferential extent of the stator blade 19 is approximately twice the circumferential extent of the stator blade at the inner ring 5. The chord length between the edges of each stator blade is substantially constant over the inner 50% of the extent of the blade, and increases with distance from the inner ring over the outer extent.

Turning now to FIG. 7C, a third form of stator blade 29 will now be described, having a medial line 212 which extends radially in a root zone at the inner ring 5 and then curving clockwise, so that the intersection of the medial line 212 with the passage member 2 is offset in a clockwise direction from the root zone. Stator blade 29 is said to be skewed in a clockwise direction.

A fourth form of stator blade 39, shown in FIG. 7D, is skewed in an Counter clockwise fashion. Thus, the medial line 312 of stator blade 39 curves anticlockwise (viewed as seen in FIG. 7D).

As with stator blade 19 shown in FIG. 7B, the stator blades 29 and 39 have a constant chord length over approximately the inner 50% of the blade and the chord length increases with distance from the inner ring in the outer part.

It has been found by analysis, and confirmed experimentally that the best performance of stator is realised when the surface area of each stator blade is less than 30% of the surface area of a fan blade. More precisely, the surface area of a stator blade should be greater than 15% and less than 30% of the surface area of a blade.

Taking the stator as a whole and the fan blades as a whole, the total surface area of the stator blades should be no more than 75% of the total surface area of the fan blades.

Although the invention envisages a number of different types of stator blade cross-section, one advantageous stator blade has one substantially flat surface in the cross-section, this surface forming the active surface for straightening the air flow whereas the opposite, so-called passive surface is curved. The active surface is the surface upon which rotational components of air flow from the fan are incident. Thus the active surface opposes the direction of rotation of the fan. Where the stator itself is linear, the result will be a first planar surface forming the active surface, and a second opposing curved surface. It will of course be understood that the stator blades need not be linear but could in fact be curved.

Figure 8:
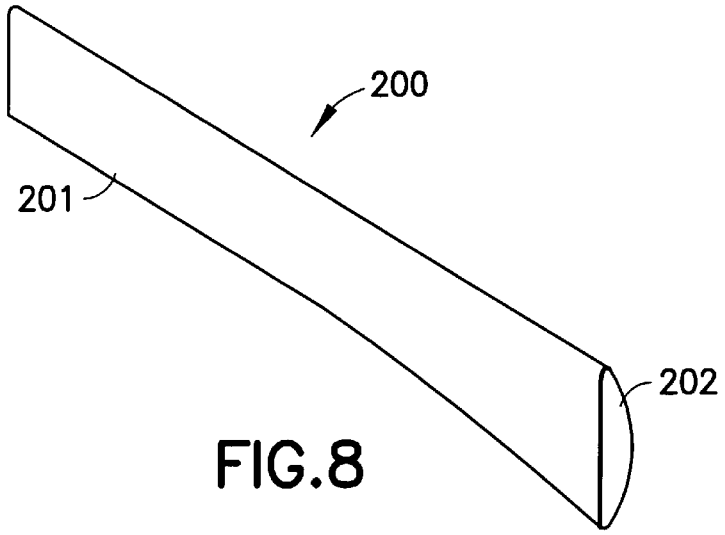
FIG. 8 shows a perspective view of a stator blade for use with the present invention.
Figure 9:
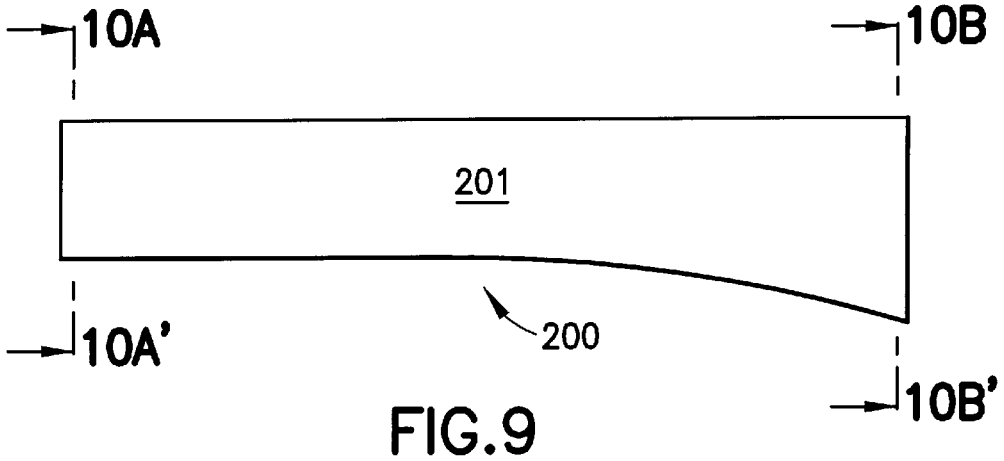
FIG. 9 shows a front elevation of the stator blade of FIG. 8.
Figure 10A:
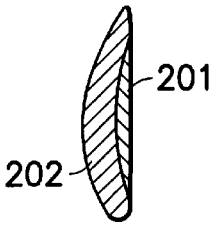
FIGS. 10*a* and 10*b* show respective cross-sections through the stator blade of FIGS. 8 and 9.
Figure 10B:
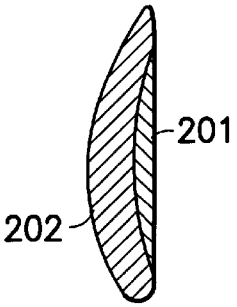

Referring to FIG. 8 a perspective view of a first straight stator blade 200 is shown, having a first planar 201 and a second opposing curved face 202. FIG. 9 shows a front elevation of the blade 200 with section lines A–A' and B–B'. FIGS. 10A and 10B show respective cross-sections along the section lines A–A' and B–B' of FIG. 9.

Figure 11:
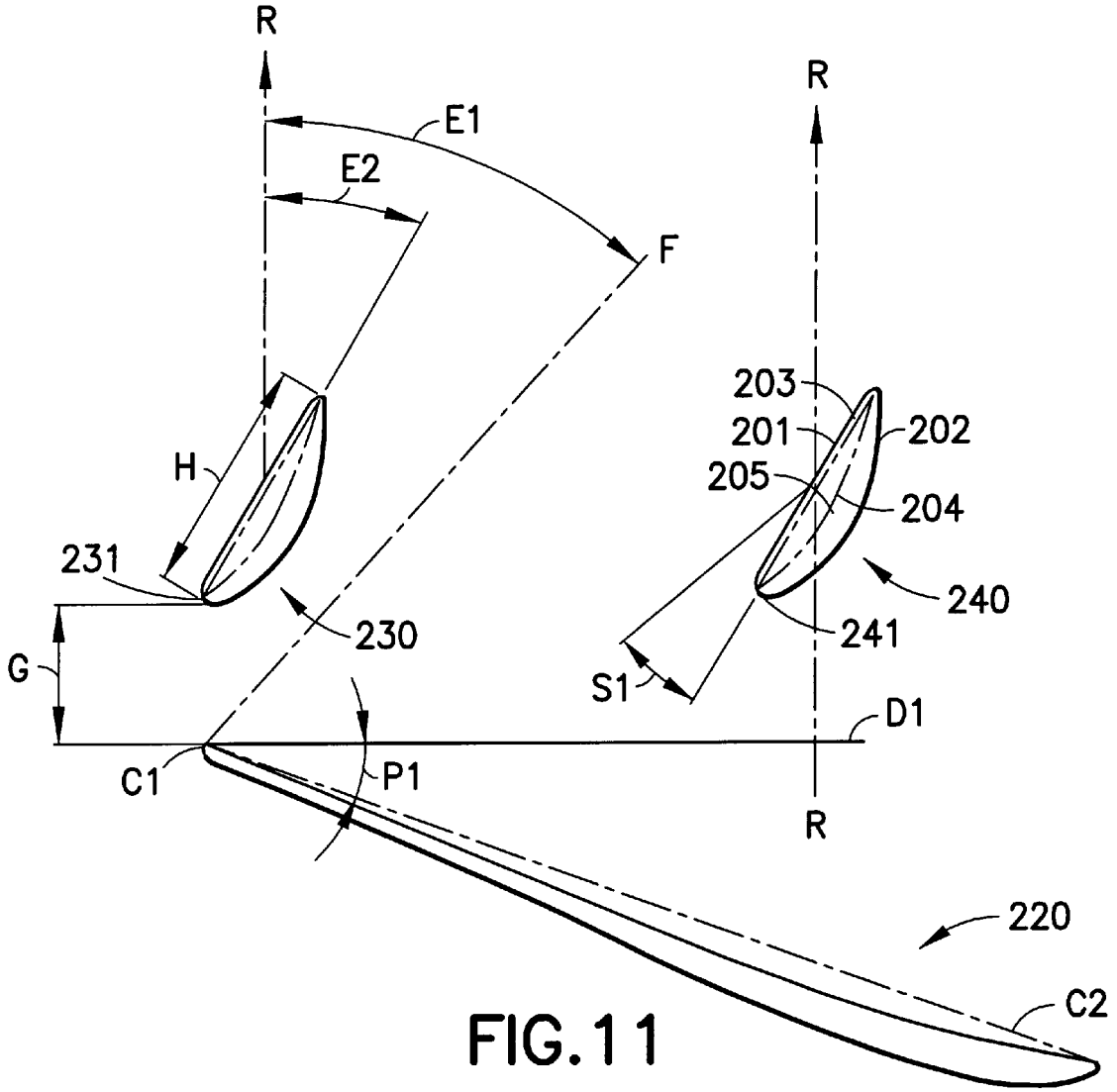
FIG. 11 shows a cross-section through a fan and stator combination taken at 70% of the fan radius.

FIG. 11 shows a cross-section taken through a fan blade 220 and two stator blades 230, 240 at a point of 70% of the fan radius.

The fan blade is pitched so that the chord formed by straight line C1-C2 makes an angle P1 to the diametric plane C1-D1. This causes the airflow C1-F to be disposed at an angle E1 to a direction R-R parallel to the axis of rotation. The trailing edge C1 of the fan blade 220 ie spaced from the leading edge 231, 241 of the stator blades by a distance G. The chord length of the stator blade is H, the spacing between the leading and trailing edges. The pitch angle of the stator blade between the stator chord and the direction R-R is E2. The active surface 201 of the blade is substantially planar and it will be seen that the air flow is incident on this surface, rather than the opposing passive surface 202 of the blade. The angle of incidence S1 of the air flow on the planar surface of the stator blade is less than the above-mentioned angle E1, and the exit angle of air flow from the stator blade is less than S1. Because of the planar nature of surface 201, and the geometry of the blade, the chord 203 of the blade 240 is parallel to the active surface 201. The cross-sectional medial line 204, which extends through the cross-section so as to be equidistant from the surfaces 201, 202 has a position of maximum deviation from the chord 203, in this case approximately halfway along the chord at point 205 and the perpendicular between the medial 204 and the chord 203 at this maximum point 205 is termed the camber of the stator blade. In the presently-described preferred embodiment, the camber is at most 6% of the chord length.

The previously discussed distance G between the trailing edge of the fan blade 220 and the leading edges 231, 241 of the stator blades is, in the preferred embodiment, at least 30% of the minimum chord of the stator.

Figure 12:
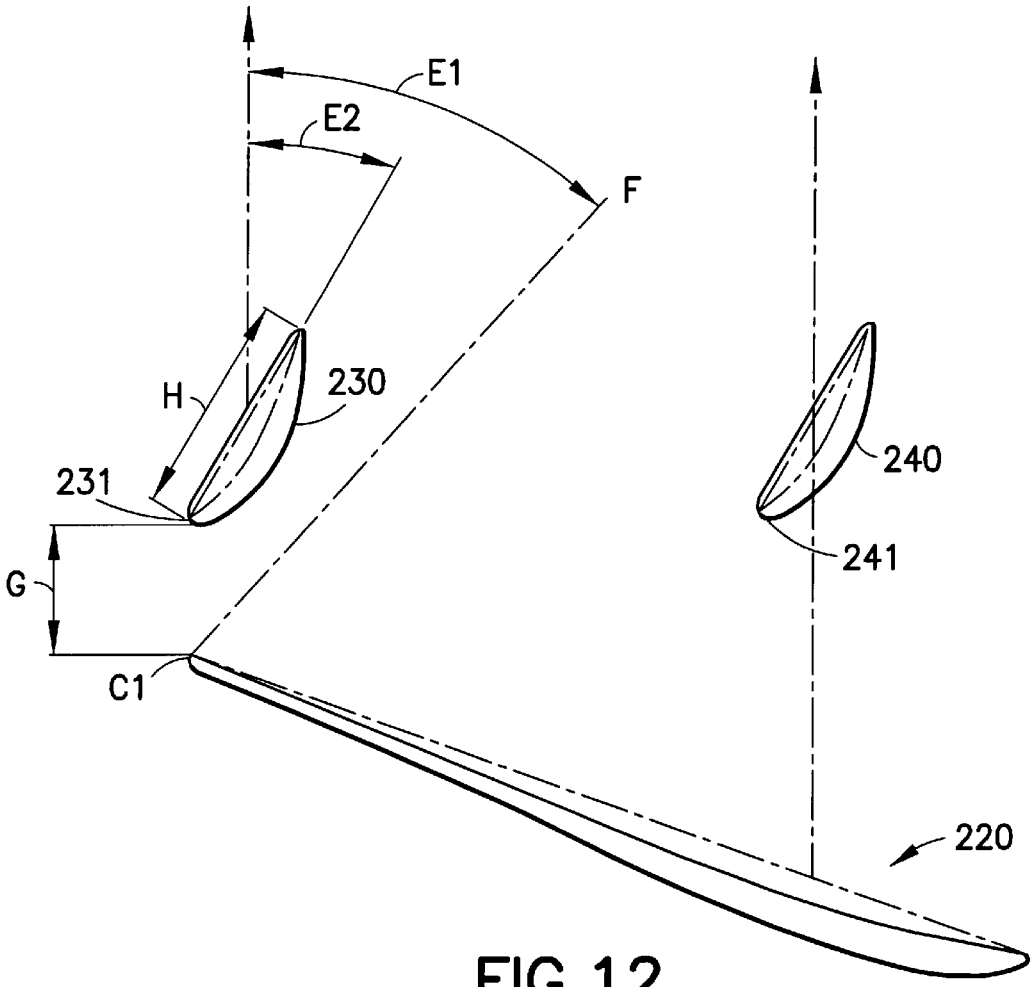
FIG. 12 shows a cross-section through a fan and stator combination taken at 80% of the fan radius.

FIG. 12 shows a similar view to that of FIG. 11, but taken at 80% of the radial extent of the blade. The chord length H at this radius is increased over the chord length at the 70% position, and the spacing G between the leading edge of the stator blades and the trailing edge C1 of the fan blade it likewise increased over the 70% position. However, the geometry of the fan blade 220 is such as to cause the air flow C1-F to be at a smaller angle E1 than the 70% position, and the pitch angle E2 is slightly less than that at the 70% position.

Figure 13:
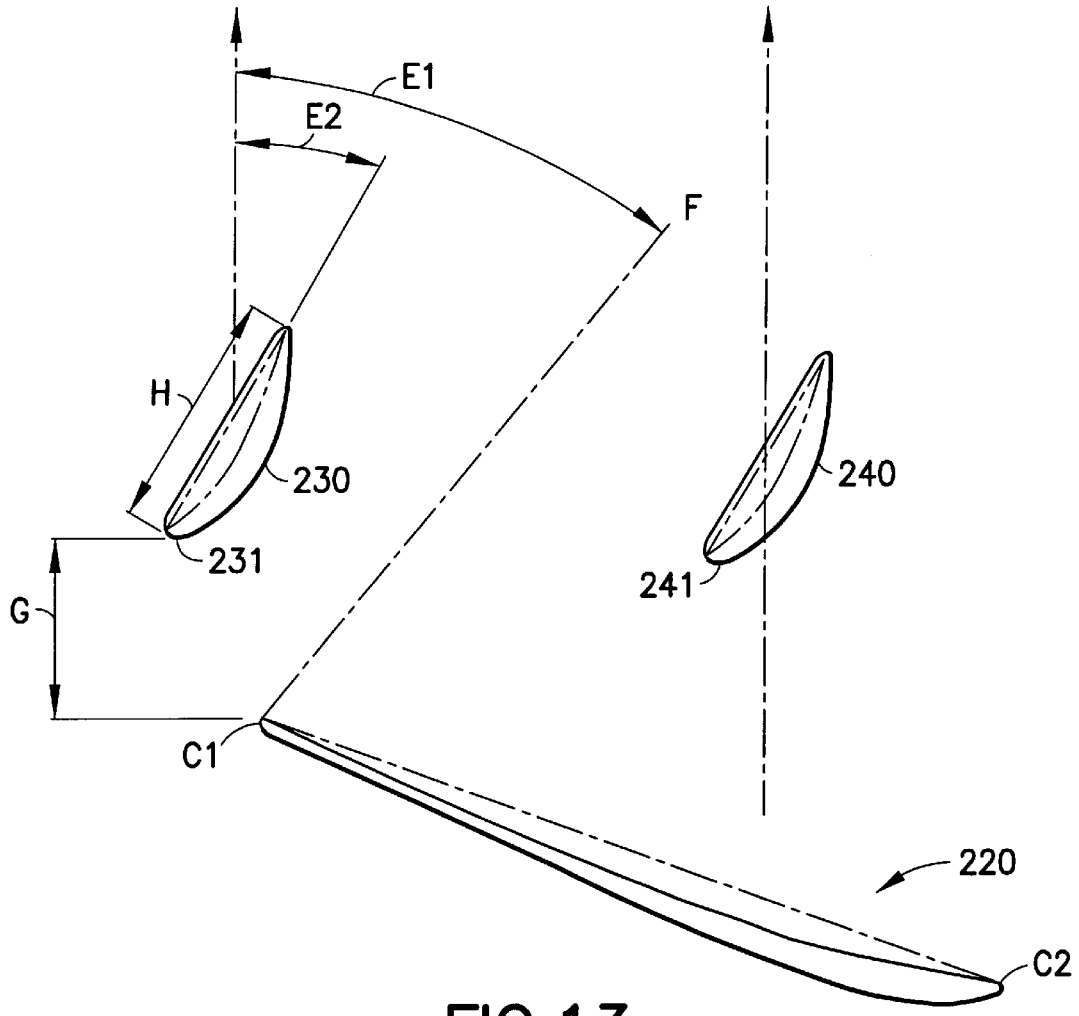
FIG. 13 shows a cross-section through a fan and stator combination taken at 90% of the fan radius.

FIG. 13 shown yet another view, similar to that of FIG. 11 but taken at 90% of the radial extent of the blade. At the 90% position, the pitch angle of the stator blade is again reduced, the stator blade chord length H is increased and the spacing G between the stator leading edge and the fan blade trailing edge C1 is again increased. The air flow angle E1 is further decreased.

There has thus been described an improved air flow directing device which acts to improve the performance of an associated fan, and an assembly of a fan and stator which has a better acoustic performance than heretofore available.

It will be understood by those skilled in the art that the described embodiments are not limitative, and that the invention extends to the full scope of the appended claims.

What is claimed is:

1. A fan assembly comprising an axial flow fan, an airflow directing device, and a support inner ring, said fan having a hub portion and a plurality of fan blades, each fan blade having a root region and a tip region, the root regions of each fan blade being secured to the hub portion, the airflow directing device having a plurality of stator blades and a stator support outer ring, said plurality of stator blades extending radially about said support inner ring, each stator blade having a tip region and a substantially constant chord length over about the first 50% of the distance between the support inner ring and the stator support outer ring, and thereafter the chord length increases, said stator blades receive air flow from said fan and divert said airflow, wherein the surface area of the stator blades is substantially less than the surface area of the fan blades.

2. The fan assembly of claim 1, wherein said stator support outer ring defines an air passage, said fan being disposed within said air passage to move air therethrough, and said stator blades are secured to said stator support outer ring at the tip region of each stator blade.

3. The fan assembly of claim 2 wherein a chord length of each stator blade varies along the length thereof.

4. The fan assembly of claim 1 wherein a clearance between the stator support outer ring and the fan is greater than 0.5% and less than 2% of the fan diameter.

5. The fan assembly of claim 1 wherein each stator blade has a chord length which varies along the blade, each fan blade is pitched to have a first edge disposed closer to said stator blades than a second edge and the minimum distance between the stator and said first edge of the fan blade edge is equal to or greater than 30% of a minimum chord length of the stator.

6. The fan assembly of claim 1 wherein each fan blade has a fan blade medial line which, in the tip region, is circumferentially offset from the fan blade medial line in the root region, wherein the fan blades are skewed, and each stator blade has a stator blade medial line which, at the tip region thereof is circumferentially offset from the stator blade medial line in the region underlying the fan hub portion wherein the stator blades are skewed, wherein the direction of the skew of the fan blades is opposite to the direction of the skew of the stator blades.

7. The fan assembly of claim 1 wherein each stator blade has a first and a second surface, said second surface opposing said first surface, wherein the maximum deviation of a line equidistant the first and second surfaces from the stator blade chord line is at most 6% of the chord length of the stator blade.

8. The fan assembly of claim 7 wherein said first surface is planar and is disposed such that rotational components of air flow from said fan are incident on said first surface.

9. The fan assembly of claim 1, wherein said plurality of stator blades does not correspond in number with said plurality of fan blades.

10. The fan assembly of claim 1 wherein an odd number of stator blades is provided.

11. The fan assembly of claim 10 wherein said odd number is a prime number.

12. The fan assembly of claim 1, wherein said fan is adapted to rotate in a predetermined senses, wherein said fan blades have a leading edge and a trailing edge, wherein the leading edge of the fan blade does not lie in the same plane as the trailing edge of the fan blade.

13. The fan assembly of claim 1 wherein said stator blades are so disposed that the angle of incidence of air flow on the stator blades is less than the exit angle of air flow from the fan blades, said exit angle being defined as the angle between the air flow from the fan blades and the axial direction of the fan.

14. The fan assembly of claim 1, wherein an angle of air incidence on the active surface in one region of the stator blade is less than an exit angle of said air.

15. The fan assembly of claim 1, wherein a camber of the stator blade corresponds to both the camber of the fan blades and the configuration of the fan blades.

16. The fan assembly of claim 1, wherein the profile of the stator blades corresponds to both the profile of the fan blades and the configuration of the fan blades.

17. The fan assembly of claim 1 wherein the surface area of the stator blades is less than 30% of the surface area of the fan blades.

18. A fan assembly comprising an axial flow fan, an airflow directing device and a support inner ring, said fan having a hub portion and a plurality of fan blades, each fan blade having a root region and a tip region, the root regions of each fan blade being secured to the hub portion, the airflow directing device having a plurality of stator blades extending radially about said support inner ring, each stator blade having a tip region, said stator blades receive air flow from said fan and divert said airflow, wherein the surface area of the stator blades is substantially less than the surface area of the fan blades, wherein each stator blade has a first and a second surface, said first surface is planar and said second surface is curved wherein said first surface is disposed such that rotational components of air flow from said fan are incident on said first surface.

19. The fan assembly of claim 18, wherein the airflow directing device further comprises a stator support outer ring, said stator support outer ring defining an air passage, said fan being disposed within said air passage to move air therethrough, and said stator blades are secured to said stator support outer ring at the tip region of each stator blade.

20. The fan assembly of claim 19 wherein a chord length of each stator blade varies along the length thereof.

21. The fan assembly of claim 18 wherein a clearance between the stator support outer ring and the fan is greater than 0.5% and less than 2% of the fan diameter.

22. The fan assembly of claim 18 wherein each stator blade has a substantially constant chord length over about the first 50% of the distance between the support inner ring and the stator support outer ring, and thereafter the chord length increases.

23. The fan assembly of claim 18 wherein each stator blade has a chord length which varies along the blade, each fan blade is pitched to have a first edge disposed closer to said stator blades than a second edge and the minimum distance between the stator and said first edge of the fan blade edge is equal to or greater than 30% of a minimum chord length of the stator.

24. The fan assembly of claim 18 wherein each fan blade has a blade medial line which, in the tip region, is circumferentially offset from the fan blade medial line in the root region, wherein the fan blades are skewed, and each stator blade has a stator blade medial line which, at the tip region thereof is circumferentially offset from the stator blade medial line in the region underlying the fan hub portion wherein the stator blades are skewed, wherein the direction of the skew of the fan blades is opposite to the direction of the skew of the stator blades.

25. The fan assembly of claim 18, wherein said plurality of stator blades does not correspond in number with said plurality of fan blades.

26. The fan assembly of claim 18 wherein an odd number of stator blades is provided.

27. The fan assembly of claim 26 wherein said odd number is a prime number.

28. The fan assembly of claim 18, wherein said fan is adapted to rotate in a predetermined sense, wherein said fan blades have a leading edge and a trailing edge, wherein the leading edge of the fan blade does not lie in the same plane as the trailing edge of the fan blade.

29. The fan assembly of claim 18 wherein said stator blades are so disposed that the angle of incidence of air flow on the stator blades is less than the exit angle of air flow from the fan blades, said exit angle being defined as the angle between the air flow from the fan blades and the axial direction of the fan.

30. The fan assembly of claim 18, wherein an angle of air incidence on the active surface in one region of the stator blade is less than an exit angle of said air.

31. The fan assembly of claim 18, wherein a camber of the stator blade corresponds to both the camber of the fan blades and the configuration of the fan blades.

32. The fan assembly of claim 18, wherein the profile of the stator blades corresponds to both the profile of the fan blades and the configuration of the fan blades.

33. The fan assembly of claim 18, wherein the surface area of the stator blades is less than 30% of the surface area of the fan blades.

34. An air flow directing device for use with an axial flow fan, the device comprising a support inner ring for supporting the fan and a plurality of stator blades extending radially about said support inner ring, said stator blades receive air flow from said fan and direct said air flow, wherein each stator blade has a tip, a first surface, and a second surface, said second surface opposing said first surface, said first surface being substantially planar and disposed such that rotational components of air flow from said fan are incident on said first surface, and said second surface being curved.

35. The air flow directing device of claim 34 wherein the maximum deviation of a line equidistant the first and second surfaces from the stator blade chord is at most 6% of the chord length.

36. The air flow directing device of claim 34 further comprising a stator support outer ring disposed at the tips of said stator blades.

37. The air flow directing device of claim 36 further comprising three support arms extending between said stator blade outer ring and said support inner ring.

38. The air flow directing device of claim 37 wherein, at least one arm is of U-shaped cross-section, whereby wiring for a fan drive motor is carried within the U-shaped cross-section.

39. The air flow directing device of claim 36 further comprising a single support arm extending between said stator support outer ring and said support inner ring.

40. The air flow directing device of claim 39 wherein at least one arm is of U-shaped cross-section and the wiring for a fan drive motor is carried within the U-shaped cross-section.

41. A method of straightening rotational components of air flow from an axial flow fan, comprising steps of:

directing the air flow from a plurality of fan blades of the fan towards a plurality of stator blades, the surface area of the stator blades is substantially less than the surface area of the fan blades, wherein each stator blade has a first and a second surface, said first surface is substantially planar and said second surface is curved and opposing the first surface;

receiving air flow from the plurality of fan blades on the first surfaces of the plurality of stator blades, wherein said first surfaces are disposed such that the rotational components of air flow from said fan blades are incident on said first surface; and diverting the air flow from the first surfaces of the plurality of stator blades.

42. A fan assembly comprising:

means for directing the air flow from a plurality of fan blades of the fan towards a plurality of stator blades, the surface area of the stator blades is substantially less than the surface area of the fan blades, wherein each stator blade has a first surface and a second surface, said first surface is substantially planar and said second surface is curved and opposing the first surface;

means for receiving air flow from the fan blades on the first surfaces of the plurality of stator blades, wherein said first surfaces are disposed such that the rotational components of air flow from said fan blades are incident on said first surface; and means for diverting the air flow from the first surfaces of the plurality of stator blades.

* * * * *

UNITED STATES PATENT AND TRADEMARK OFFICE

CERTIFICATE OF CORRECTION

PATENT NO. : 6,142,733

DATED : November 7, 2000

INVENTOR(S) : Ahmad Alizadeh and Antony Szczodrowski

It is certified that error appears in the above-identified patent and that said Letters Patent is hereby corrected as shown below:

In Claim 12, line 2, "senses" should read --sense--.

Signed and Sealed this

Eighth Day of May, 2001

*Attest:*

Nicholas P. Godici

NICHOLAS P. GODICI

*Attesting Officer*

*Acting Director of the United States Patent and Trademark Office*